United States Patent [19]

Stoltman

[11] 4,175,103

[45] Nov. 20, 1979

[54] CARBURETOR

[75] Inventor: Donald D. Stoltman, Henrietta, N.Y.

[73] Assignee: General Motors Corporation, Detroit, Mich.

[21] Appl. No.: 959,104

[22] Filed: Nov. 9, 1978

Related U.S. Application Data

[63] Continuation-in-part of Ser. No. 896,684, Apr. 17, 1978, abandoned.

[51] Int. Cl.[2] ..... F02M 7/18

[52] U.S. Cl. ..... 261/50 R; 123/119 EC; 137/595; 137/625.65; 261/67; 261/121 B; 261/DIG. 74

[58] Field of Search ..... 261/121 B, DIG. 74, 261/50 R, 67; 123/119 EC, 32 EE, 32 EA; 137/595, 625.65; 251/129

[56] References Cited

U.S. PATENT DOCUMENTS

| | | | |
|---|---|---|---|
| 1,197,571 | 9/1916 | Bessom | 261/121 B |
| 1,207,029 | 12/1916 | Guthrie | 261/67 |
| 1,733,348 | 10/1929 | Juhasz | 261/66 |
| 2,220,558 | 11/1940 | Van Dijck et al. | 123/198 |
| 2,355,090 | 8/1944 | Love et al. | 261/DIG. 74 |
| 2,369,698 | 2/1945 | Willenborg | 123/119 R |
| 2,747,561 | 5/1956 | Dietrich | 261/DIG. 74 |
| 2,791,995 | 5/1957 | Dietrich | 261/DIG. 74 |
| 2,831,471 | 4/1958 | Schoonover | 261/DIG. 74 |
| 2,914,034 | 11/1959 | Becker | 137/625.65 |
| 2,981,245 | 4/1961 | Sarto | 261/121 B |
| 3,313,532 | 4/1967 | Carlson et al. | 261/121 B |
| 3,409,277 | 11/1968 | Reise | 261/51 |
| 3,425,672 | 2/1969 | Seigel et al. | 261/121 B |
| 3,454,264 | 7/1969 | Sarto | 261/121 B |
| 3,460,573 | 8/1969 | Beveridge et al. | 137/625.65 |
| 3,469,590 | 9/1969 | Barker | 251/129 |
| 3,498,330 | 3/1970 | Paige | 137/625.65 |
| 3,528,455 | 9/1970 | Kreuter et al. | 137/625.65 |
| 3,575,390 | 4/1971 | Bickhaus et al. | 261/121 B |
| 3,608,585 | 9/1971 | Huntington | 137/625.65 |
| 3,633,869 | 1/1972 | Lehmann | 251/129 |
| 3,667,739 | 6/1972 | Menke | 261/1 |
| 3,693,947 | 9/1972 | Masaki et al. | 261/39 D |
| 3,703,888 | 11/1972 | Eckert et al. | 123/139 AW |
| 3,706,444 | 12/1972 | Masaki et al. | 261/121 B |
| 3,744,346 | 7/1973 | Miner et al. | 261/69 R |
| 3,745,983 | 7/1973 | Sweeney | 261/50 A |
| 3,827,237 | 8/1974 | Linder et al. | 123/32 EA |
| 3,827,672 | 8/1974 | Stampfli | 137/625.65 |
| 3,841,283 | 10/1974 | Wood | 261/DIG. 74 |
| 3,852,383 | 12/1974 | Seaman | 261/69 R |
| 3,855,974 | 12/1974 | Mayer | 123/32 EA |
| 3,859,397 | 1/1975 | Tryon | 261/121 B |
| 3,861,366 | 1/1975 | Masaki et al. | 123/32 EA |
| 3,872,188 | 3/1975 | Brown et al. | 261/121 B |
| 3,874,171 | 4/1975 | Schmidt et al. | 123/32 EA |
| 3,899,552 | 8/1975 | Bauer | 261/DIG. 74 |
| 3,906,910 | 9/1975 | Szlaga et al. | 261/121 B |
| 3,921,612 | 11/1975 | Aono | 123/32 EA |
| 3,933,951 | 1/1976 | Fischer et al. | 261/121 B |
| 3,936,516 | 2/1976 | Nakagawa et al. | 261/121 B |
| 3,939,654 | 2/1976 | Creps | 60/276 |
| 3,942,493 | 3/1976 | Linder et al. | 261/DIG. 74 |
| 3,960,118 | 6/1976 | Konomi et al. | 123/32 EA |
| 3,963,009 | 6/1976 | Mennesson | 123/119 D |
| 3,994,998 | 11/1976 | Mineck | 261/50 A |
| 4,006,718 | 2/1977 | Konomi | 123/32 EA |
| 4,019,470 | 4/1977 | Asano | 123/32 EE |
| 4,019,474 | 4/1977 | Nishimiya | 123/32 EE |
| 4,023,357 | 5/1977 | Masaki | 123/119 EC |
| 4,027,637 | 6/1977 | Ano | 123/119 EC |
| 4,030,292 | 6/1977 | Masaki et al. | 123/119 EC |
| 4,030,462 | 6/1977 | Sasayama et al. | 123/119 EC |
| 4,036,186 | 7/1977 | Hattori et al. | 123/32 EA |
| 4,046,118 | 9/1977 | Aono | 123/119 EC |
| 4,046,165 | 9/1977 | Rose, Sr. et al. | 137/625.64 |
| 4,052,968 | 10/1977 | Hattori et al. | 123/119 EC |
| 4,056,931 | 11/1977 | Hata | 123/119 EC |
| 4,056,932 | 11/1977 | Nakamura et al. | 60/276 |
| 4,057,042 | 11/1977 | Aono | 123/119 EC |
| 4,065,920 | 1/1978 | Minami | 123/119 EC |
| 4,091,777 | 5/1978 | Monpetit et al. | 123/97 B |
| 4,091,780 | 5/1978 | Masaki et al. | 261/41 D |
| 4,091,781 | 5/1978 | Mituyasu et al. | 123/119 EC |
| 4,092,961 | 6/1978 | Yamada et al. | 123/119 EC |
| 4,095,570 | 6/1978 | Sheffer | 123/119 EC |
| 4,100,234 | 7/1978 | Lindberg et al. | 261/121 B |
| 4,102,526 | 7/1978 | Hargraves | 137/625.65 |
| 4,103,657 | 8/1978 | Minami | 123/119 EC |
| 4,103,695 | 8/1978 | Aono | 123/119 EC |
| 4,114,372 | 9/1978 | Ikeura | 261/121 B |

FOREIGN PATENT DOCUMENTS

| | | | |
|---|---|---|---|
| 2559079 | 9/1976 | Fed. Rep. of Germany | 261/121 B |

| | | | |
|---|---|---|---|
| 2715014 | 12/1977 | Fed. Rep. of Germany | 123/119 EC |
| 2753452 | 7/1978 | Fed. Rep. of Germany | 123/119 EC |
| 1517433 | 7/1978 | United Kingdom | 261/121 B |
| 316075 | 11/1971 | U.S.S.R. | 137/625.65 |

OTHER PUBLICATIONS

SAE Paper, 770,352, 2-28-77, Gantzert et al.

1975 Buick Chassis Service Manual, pp. 6E-1 to 6E-17, G. M. Corp.

Carter Carburetor Sketches TQ and YF/YFA.

Rochester Products Bulletin 9D-5, "Quadrajet," G. M. Corp., 10-1965.

Research Disclosure, Feb. 1978, p. 19.

Society of Automotive Engineers; Technical Paper 780,204; 2-27-78, Masaki et al.

*Primary Examiner*—Tim R. Miles
*Attorney, Agent, or Firm*—C. K. Veenstra

[57] ABSTRACT

In a carburetor, an electromagnet energized according to a pulse width modulated duty cycle has a stationary pole member which drives a pair of magnetically responsive valves—one or both being permanently magnetic—to control fuel flow through a main metering orifice and air flow through an idle air bleed.

12 Claims, 3 Drawing Figures

CARBURETOR

This is a continuation-in-part of application Ser. No. 896,684 filed Apr. 17, 1978, now abandoned.

TECHNICAL FIELD

This invention relates to a carburetor particularly suitable for operation in a closed loop fuel system.

BACKGROUND

Several carburetors have been proposed for the purpose of creating an air-fuel mixture of substantially constant (usually stoichiometric) air-fuel ratio for an internal combustion engine. In general, it has been contemplated that such a carburetor would be used in a closed loop system having a sensor—such as a sensor that measures the oxygen content of the engine exhaust gases as an indication of the air-fuel ratio of the mixture created by the carburetor—which would initiate a feedback signal causing the carburetor to create a mixture of the desired air-fuel ratio.

Certain carburetors proposed for that application have metering apparatus which includes a solenoid armature driven between rich and lean positions according to a pulse width modulated duty cycle. The duty cycle operated solenoid thus maintains the metering apparatus in the lean position for a selected portion of the duty cycle and in the rich position for the remainder of the duty cycle, and the carburetor thus pulse width modulates the fuel flow and then averages high and low fuel flows to create a mixture of the desired air-fuel ratio.

It will be appreciated that, with such a carburetor, the solenoid must operate at a frequency sufficiently high to avoid inducing objectionable engine surge which could result from the alternate high and low fuel flows. The metering apparatus accordingly is subject to a minimum frequency limitation, and its mass and frictional characteristics must be low enough to permit its movement between the rich and lean positions at the minimum frequency over the desired range of duty cycle pulse widths.

SUMMARY OF THE INVENTION

This invention provides a carburetor having structure particularly suited for direct pulse width modulation of the fuel flow. In this carburetor the metering apparatus comprises valves controlling a main metering orifice and an idle air bleed which are driven by a stationary electromagnet pole member; the mass and frictional characteristics of the metering apparatus in this carburetor accordingly may be substantially lower than that of the metering apparatus in the carburetors which have a moving solenoid armature that mechanically drives metering and bleed valves.

According to this invention, both the main metering valve and the idle air bleed valve are magnetically responsive and one or both of the valves is permanently magnetic. When the electromagnet is not energized one valve is attracted by the pole member to one position and the other valve is biased to a corresponding position, and when the electromagnet coil is energized the first valve is repelled by the pole member to an opposite position and the bias of the second valve is overcome by the attraction of the pole member and moves to a correspondingly opposite position. The two valves thereby move in unison, and in one position the metering valve restricts fuel flow through the main metering orifice while the bleed valve permits increased air flow through the idle air bleed to restrict idle fuel flow; in the opposite position the metering valve permits increased fuel flow through the main metering orifice while the bleed valve restricts air flow through the idle air bleed to permit increased idle fuel flow.

The details as well as other features and advantages of this invention are set forth below and are shown in the drawings.

BEST MODE FOR CARRYING OUT THE INVENTION

Figure 1:
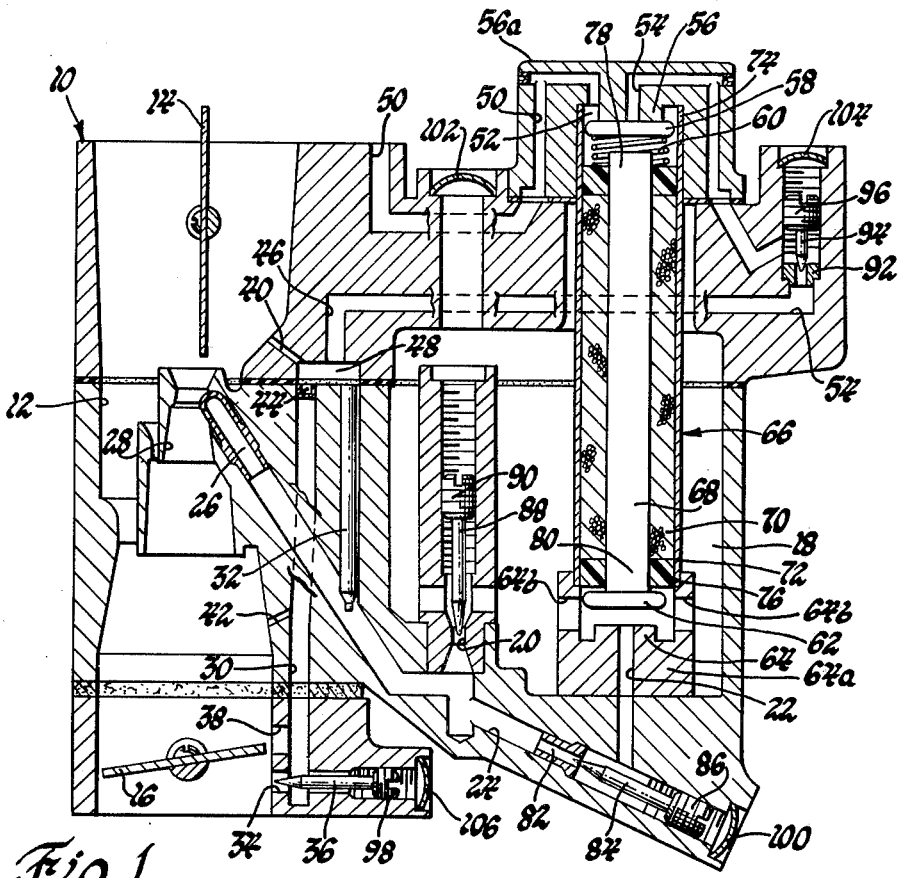
FIG. 1 is a schematic view of the main and idle metering systems of a carburetor employing this invention and in which the metering apparatus is driven to the rich position when the electromagnet coil is not energized.

Referring first to FIG. 1, an internal combustion engine carburetor 10 has an air induction passage 12 controlled by a choke 14 and a throttle 16. A fuel bowl 18 delivers fuel through a primary main metering orifice 20 and a supplementary main metering orifice 22 into a main fuel passage 24 which discharges through a nozzle 26 into a venturi cluster 28 disposed in induction passage 12.

An idle fuel passage 30 has a pick-up tube 32 extending into main fuel passage 24, an idle discharge port 34 opening into induction passage 12 past a mixture adjusting needle 36, and an off-idle port 38 opening into induction passage 12 adjacent throttle 16.

The usual side idle air bleed 40 and lower idle air bleed 42 open into idle fuel passage 30 on opposite sides of an idle channel restriction 44, and an air bleed passage 46 extends to the upper portion 48 of idle fuel passage 30. Air bleed passage 46 includes an inlet portion 50 extending to an annular region 52 and a discharge portion 54 which opens through a boss 56 surrounded by annular region 52 and leads to idle fuel passage 30.

An air bleed valve disc 58 controls air flow from annular region 52 to discharge portion 54 of air bleed passage 46. Bleed valve 58 is biased by a spring 60 to seat across boss 56, thereby restricting air flow through bleed passage 46 to permit increased fuel flow through idle fuel passage 30. When bleed valve 58 is displaced from boss 56, the increased air flow permitted through bleed passage 46 restricts fuel flow through idle fuel passage 30.

A metering valve disc 62 controls fuel flow from fuel bowl 18 through supplementary metering orifice 22. When metering valve 62 engages a boss 64 surrounding supplementary metering orifice 22, it restricts fuel flow through orifice 22 and passage 24. With metering valve 62 displaced from boss 64 as shown, increased fuel flow is permitted through orifice 22 and main fuel passage 24.

Bleed valve 58 and metering valve 62 comprise metering apparatus which is driven by an electromagnet assembly 66. Electromagnet assembly 66 includes a stationary electromagnet pole member 68 disposed within an electromagnet coil 70. Coil 70 is surrounded by a casing 72 which extends past bleed valve 58 at its upper end 74 but terminates above metering valve 62 at its lower end 76.

Both bleed valve 58 and metering valve 62 are magnetically responsive, and metering valve 62 is permanently magnetic. Thus when coil 70 is energized, magnetically responsive bleed valve 58 is attracted against the bias of spring 60 to a lean position engaging the upper end 78 of pole member 68—thereby permitting increased air flow through bleed passage 46 to restrict fuel flow through idle fuel passage 30. In addition, when coil 70 is energized, permanently magnetic metering valve 62 is repelled by the lower end 80 of pole member 68 to a lean position engaging boss 64—thereby restricting fuel flow through metering orifice 22 and main fuel passage 24.

When coil 70 is not energized, spring 60 moves bleed valve 58 to a rich position engaging boss 56—thereby restricting air flow through bleed passage 46 to permit increased fuel flow through idle fuel passage 30. In addition, when coil 70 is not energized, permanently magnetic metering valve 62 is attracted to a rich position engaging the lower end 80 of pole member 68—thereby permitting increased fuel flow through metering orifice 22.

It is contemplated that coil 70 will be energized according to a duty cycle of at least about 10 Hz having a pulse width determined by a sensor measuring the air-fuel ratio of the mixture created by carburetor 10—such as a sensor measuring the oxygen content of the engine exhaust gases—and accordingly will repel metering valve 62 against boss 64 and attract bleed valve 58 against the upper end 78 of pole member 68 for a selected portion of the duty cycle while permitting spring 60 to engage bleed valve 58 against boss 56 and attracting metering valve 62 against the lower end 80 of pole member 68 for the remainder of the duty cycle; carburetor 10 thus will pulse width modulate the fuel flow and then average high and low fuel flows to create a mixture having a stoichiometric air-fuel ratio or any other desired air-fuel ratio.

It also is contemplated that boss 56 will be a portion of an aluminum member 56*a*, that boss 64 will be a portion of a brass member 64*a* having apertures 64*b* to allow fuel flow from fuel bowl 18 to supplementary metering orifice 22, and that valve discs 58 and 62 will be formed either of a synthetic rubber carrying magnetically responsive particles or with a synthetic rubber material bonded to the boss-engaging faces thereof.

A restriction 82 is disposed in main fuel passage 24 between primary metering orifice 20 and supplementary metering orifice 22. A rich adjusting needle 84 has a threaded stem 86 allowing adjustment of needle 84 in restriction 82 to limit fuel flow through supplementary metering orifice 22 and thus establish the maximum fuel flow through main fuel passage 24 to set the rich part throttle authority for carburetor 10. A lean adjusting needle 88 is disposed in primary metering orifice 20 and has a threaded stem 90 allowing adjustment of needle 88 in primary metering orifice 20 to limit fuel flow through primary metering orifice 20 and thus establish the minimum fuel flow through main fuel passage 24 to set the lean part throttle authority for carburetor 10.

A restriction 92 is disposed in the discharge portion 54 of bleed passage 46. An air bleed adjusting needle 94 is disposed in restriction 92 and has a threaded stem 96 allowing adjustment of needle 94 in restriction 92 to limit air flow through bleed passage 46 and thus control fuel flow through idle fuel passage 30 to set the lean idle authority for carburetor 10. Mixture adjusting needle 36 has a threaded stem 98 allowing adjustment of needle 36 in port 34 to limit fuel flow through port 34 and thus establish the maximum fuel flow through idle fuel passage 30 to set the rich idle authority for carburetor 10.

Plugs 100, 102, 104 and 106 are installled to seal access to rich and lean adjusting needles 84 and 88, air bleed adjusting needle 94 and mixture needle 36.

With this construction the carburetor metering apparatus will meter fuel flow between the rich authority and the lean authority when coil 70 is operated at any duty cycle pulse width between 0% and 100%.

It will be appreciated that this invention may be embodied in a two-barrel carburetor by addition of another induction passage 12, main fuel passage 24, supplementary metering orifice 22 (with perhaps another primary metering orifice 20), idle fuel passage 30, and a segment of an air bleed passage which branches from discharge portion 54 downstream of air bleed adjusting needle 94 to the second idle fuel passage; duplication of electromagnet assembly 66, bleed valve 58 and metering valve 62 is not required. Moreover, this invention may be embodied in a multiple stage carburetor by addition of one or more secondary stage induction passages and associated systems of conventional construction.

Figure 2:
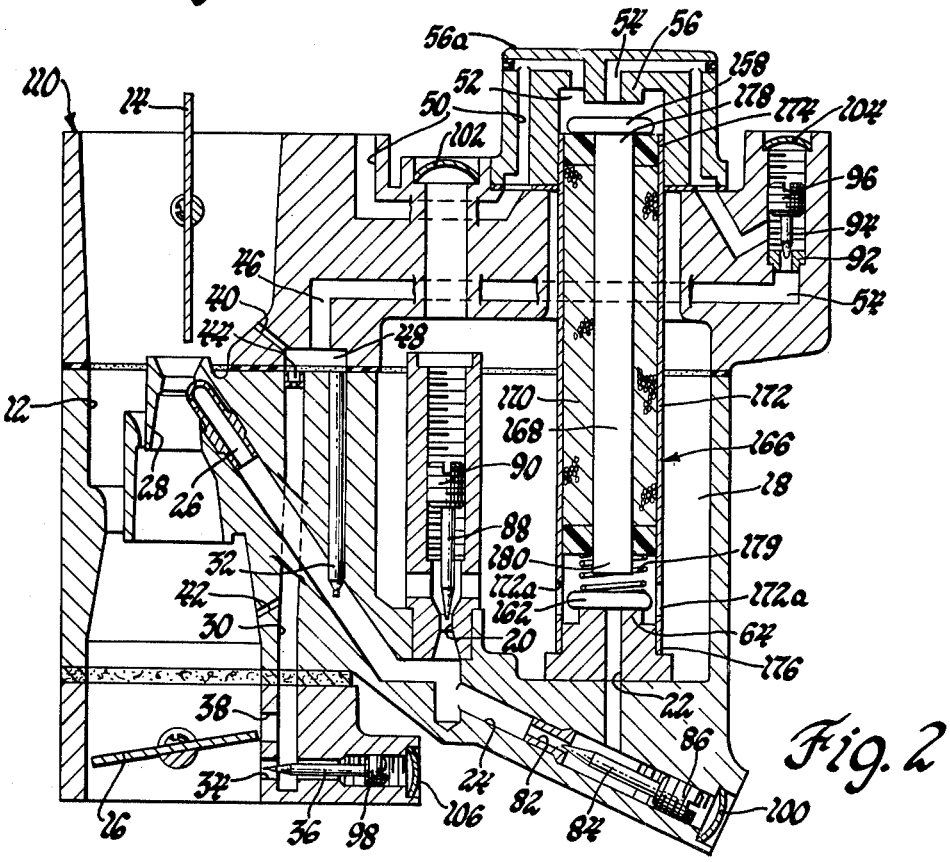
FIG. 2 is a view, similar to FIG. 1, of another carburetor employing this invention and in which the metering apparatus is driven to the lean position when the electromagnet coil is not energized.

FIG. 2 illustrates a carburetor 110 identical in many respects to carburetor 10, and the same reference numerals are used to identify identical parts.

Referring to FIG. 2, a bleed valve 158 and a metering valve 162 comprise metering apparatus which is driven by an electromagnet assembly 166. Electromagnet assembly 166 includes a stationary electromagnet pole member 168 disposed within an electromagnet coil 170. Coil 170 is surrounded by a casing 172 which terminates below bleed valve 158 at its upper end 174 but extends past metering valve 162 at its lower end 176 and has apertures 172*a* to allow fuel flow from fuel bowl 18 to supplementary metering orifice 22.

Both bleed valve 158 and metering valve 162 are magnetically responsive, and bleed valve 158 is permanently magnetic. Thus when coil 170 is not energized, permanently magnetic bleed valve 158 is attracted to a lean position engaging the upper end 178 of pole member 168—thereby permitting increased air flow through bleed passage 46 to restrict fuel flow through idle fuel passage 30. In addition, when coil 170 is not energized, magnetically responsive metering valve 162 is moved by a spring 179 to a lean position engaging boss 64—thereby restricting fuel flow through metering orifice 22 and main fuel passage 24.

When coil 170 is energized, permanently magnetic bleed valve 158 is repelled by the upper end 178 of pole member 168 to a rich position engaging boss 56—thereby restricting air flow through bleed passage 46 to permit increased fuel flow through idle fuel passage 30. In addition, when coil 170 is energized, metering valve 162 is attracted against the bias of spring 179 to a rich position engaging the lower end 180 of pole member 168—thereby permitting increased fuel flow through metering orifice 22.

It is contemplated that coil 170 will be energized according to a duty cycle of at least about 10 Hz having a pulse width determined by a sensor measuring the air-fuel ratio of the mixture created by carburetor 110—such as a sensor measuring the oxygen content of the engine exhaust gases—and accordingly will repel bleed valve 158 against boss 56 and attract metering valve 162 against the lower end 180 of pole member 168 for a selected portion of the duty cycle while permitting spring 179 to engage metering valve 162 against boss 64 and attracting bleed valve 158 against the upper end 178 of pole member 68 for the remainder of the duty cycle; carburetor 110 thus will pulse width modulate the fuel flow and then average high and low fuel flows to create a mixture having a stoichiometric air-fuel ratio or any other desired air-fuel ratio.

Figure 3:
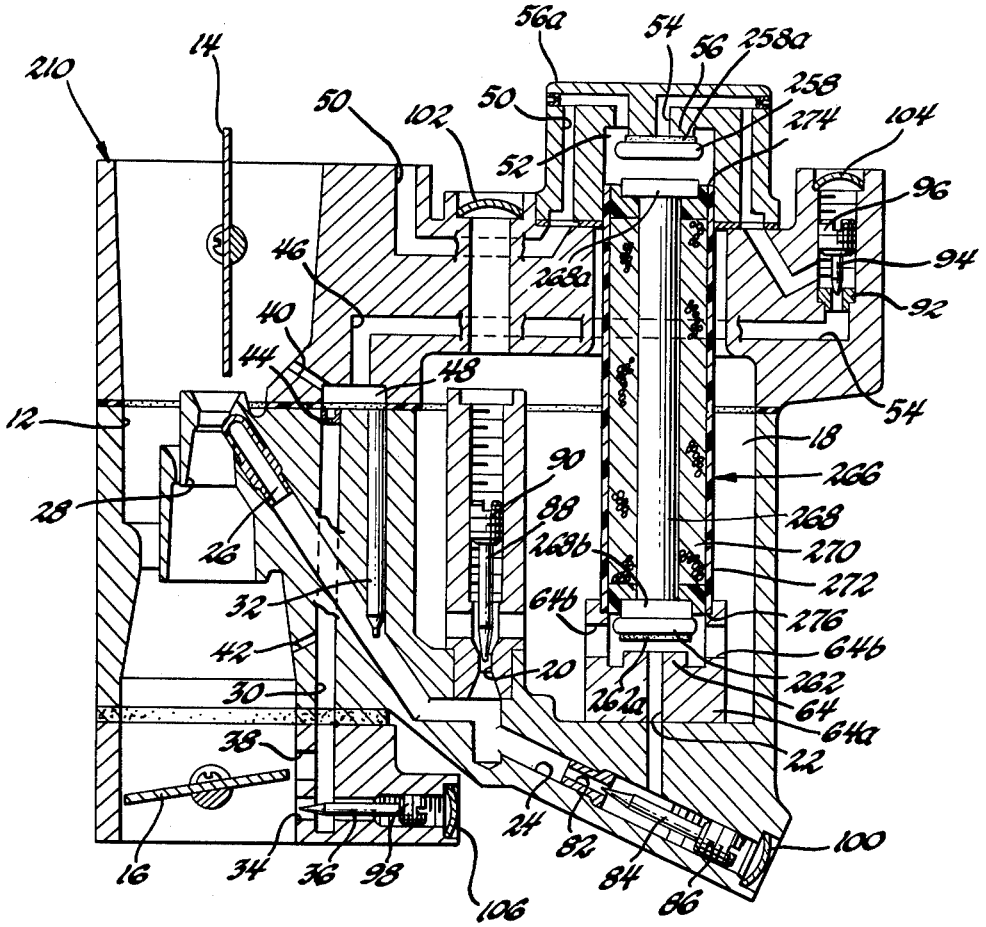
FIG. 3 is a view, similar to FIG. 1, of yet another carburetor employing this invention and in which both the metering valve and the bleed valve are permanently magnetic and are driven to the rich position when the electromagnet coil is not energized. The improved embodiment of this invention shown in FIG. 3 was invented by T. K. Sheffer and is specifically claimed in U.S. patent application Ser. No. 17,080, filed Mar. 2, 1979.

FIG. 3 illustrates a carburetor 210 also identical in many respects to carburetor 10, and the same reference numerals are used to identify identical parts.

Referring to FIG. 3, a bleed valve 258 and a metering valve 262 comprise metering apparatus which is driven by an electromagnet assembly 266. Electromagnet assembly 266 includes a stationary electromagnet pole member 268 disposed within an electromagnet coil 270. Coil 270 is surrounded by a casing 272 which terminates below bleed valve 258 at its upper end 274 and terminates above metering valve 262 at its lower end 276.

Both bleed valve 258 and metering valve 262 are permanently magnetic, and permanently magnetic discs 268*a* and 268*b* are disposed at opposite ends of pole member 268 and extend slightly beyond the upper and lower ends 274 and 276 of casing 272. When coil 70 is not energized, permanently magnetic bleed valve 258 is repelled by permanently magnetic disc 268*a* and thus is biased to a rich position engaging boss 56—thereby restricting air flow through bleed passage 46 to permit increased fuel flow through idle fuel passage 30. In addition when coil 270 is not energized, permanently magnetic metering valve 262 is attracted by permanently magnetic disc 268*b* and thus is biased to a rich position engaging disc 268*b*—thereby permitting increased fuel flow through metering orifice 22.

When coil 270 is energized, bleed valve 258 is attracted against the bias of disc 268*a* to a lean position engaging disc 268*a*—thereby permitting increased air flow through bleed passage 46 to restrict fuel flow through idle fuel passage 30. In addition, when coil 270 is energized, metering valve 262 is repelled against the bias of disc 268*b* to a lean position engaging boss 64—thereby restricting fuel flow through metering orifice 22 and main fuel passage 24.

It is contemplated that coil 270 will be energized according to a duty cycle of about 15 Hz having a pulse width determined by a sensor measuring the air-fuel ratio of the mixture created by carburetor 210—such as a sensor measuring the oxygen content of the engine exhaust gases—and accordingly will repel metering valve 262 against boss 64 and attract bleed valve 258 against disc 268*a* for a selected portion of the duty cycle while permitting disc 268*a* to repel bleed valve 258 against boss 56 and disc 268*b* to attract metering valve 262 for the remainder of the duty cycle; carburetor 210 thus will pulse width modulate the fuel flow and then average high and low fuel flows to create a mixture having a stoichiometric air-fuel ratio or any other desired air-fuel ratio.

Valves 258 and 262 and discs 268*a* and 268*b* are formed of a ferrite filled nylon or of other fuel resistant synthetics carrying magnetic particles, and valves 258 and 262 are provided with an epichlorohydrin coated dacron or other fuel resistant synthetic gasket 258*a* and 262*a* bonded to the boss-engaging faces thereof. (In this respect, it will be noted that the boss-engaging surfaces of valves 258 and 262 are of the same polarity and valves 258 and 262 thus are interchangeable.)

The FIG. 3 embodiment is particularly advantageous because both the metering valve 262 and the bleed valve 258 are driven both to the rich position and to the lean position by magnetic forces and synchronous operation of the valves is thereby assured.

The embodiments of the invention in which an exclusive property or privilege is claimed are defined as follows:

1. A carburetor comprising main and idle fuel passages, a metering orifice in said main fuel passage, an air bleed opening into said idle fuel passge, and a metering apparatus reciprocable between a rich position and a lean position, said metering apparatus including a metering valve engaged with said metering orifice in said lean position to restrict fuel flow through said main fuel passage and displaced from said metering orifice in said rich position to permit increased fuel flow through said main fuel passage, said metering apparatus further including a bleed valve engaged with said air bleed in said rich position to restrict air flow through said air bleed and thereby permit increased fuel flow through said idle fuel passage and displaced from said air bleed in said lean position to permit increased air flow through said air bleed and thereby restrict fuel flow through said idle fuel passage, wherein said valves are magnetically responsive and at least one of said valves is permanently magnetic, and wherein said carburetor further comprises an electromagnet pole member associated with said valves, an electromagnet coil surrounding said pole member for causing said pole member to repel said one valve and attract the other valve to one of said rich and lean positions when said coil is energized and for causing said pole member to attract said one valve to the other of said rich and lean positions when said coil is deenergized, and means for biasing said other valve to said other positions when said coil is deenergized.

2. A carburetor comprising main and idle fuel passages, a metering orifice in said main fuel passage, an air bleed opening into said idle fuel passage, and a metering apparatus reciprocable between a rich position and a lean position, said metering apparatus including a metering valve engaged with said metering orifice in said lean position to restrict fuel flow through said main fuel passage and displaced from said metering orifice in said rich position to permit increased fuel flow through said main fuel passage, said metering apparatus further including a bleed valve engaged with said air bleed in said rich position to restrict air flow through said air bleed and thereby permit increased fuel flow through said idle fuel passage and displaced from said air bleed in said lean position to permit increased air flow through said air bleed and thereby restrict fuel flow through said idle fuel passage, wherein said valves are magnetically responsive and at least one of said valves is permanently magnetic, and wherein said carburetor further comprises an electromagnet pole member associated with said valves, an electromagnet coil surrounding said pole member and energized according to a duty cycle which causes said pole member to repel said one valve and attract the other valve to one of said rich and lean positions during a portion of the duty cycle and causes said pole member to attract said one valve to the other of said rich and lean positions during the remainder of the duty cycle, and means for biasing said other valve to said other position during the remainder of the duty cycle.

3. A carburetor comprising main and idle fuel passages, a metering orifice in said main fuel passage, an air bleed opening into said idle fuel passage, and a metering apparatus reciprocable between a rich position and a lean position, said metering apparatus including a metering valve engaged with said metering orifice in said lean position to restrict fuel flow through said main fuel passage and displaced from said metering orifice in said rich position to permit increased fuel flow through said main fuel passage, said metering apparatus further including a bleed valve engaged with said air bleed in said rich position to restrict air flow through said air bleed and thereby permit increased fuel flow through said idle fuel passage and displaced from said air bleed in said lean position to permit increased air flow through said air bleed and thereby restrict fuel flow through said idle fuel passage, wherein said valves are magnetically responsive and at least one of said valves is permanently magnetic, and wherein said carburetor further comprises an electromagnet pole member associated with said valves, an electromagnet coil surrounding said pole member for causing said pole member to repel said one valve and attract the other valve to said lean position when said coil is energized and for causing said pole member to attract said one valve to said rich position when said coil is deenergized, and means for biasing said other valve to said rich position when said coil is deenergized.

4. A carburetor comprising main and idle fuel passages, a metering orifice in said main fuel passage, an air bleed opening into said idle fuel passage, and a metering apparatus reciprocable between a rich position and a lean position, said metering apparatus including a metering valve engaged with said metering orifice in said lean position to restrict fuel flow through said main fuel passage and displaced from said metering orifice in said rich position to permit increased fuel flow through said main fuel passage, said metering apparatus further including a bleed valve engaged with said air bleed in said rich position to restrict air flow through said air bleed and thereby permit increased fuel flow through said idle fuel passage and displaced from said air bleed in said lean position to permit increased air flow through said air bleed and thereby restrict fuel flow through said idle fuel passage, wherein said valves are magnetically responsive and at least said metering valve is permanently magnetic, and wherein said carburetor further comprises an electromagnet pole member associated with said valves, an electromagnet coil surrounding said pole member for causing said pole member to repel said metering valve and attract said bleed valve to one of said rich and lean positions when said coil is energized and for causing said pole member to attract said metering valve to the other of said rich and lean positions when said coil is deenergized, and means for biasing said bleed valve to said other position when said coil is deenergized.

5. A carburetor comprising main and idle fuel passages, a metering orifice in said main fuel passage, an air bleed opening into said idle fuel passage, and a metering apparatus reciprocable between a rich position and a lean position, said metering apparatus including a metering valve engaged with said metering orifice in said lean position to restrict fuel flow through said main fuel passage and displaced from said metering orifice in said rich position to permit increased fuel flow through said main fuel passage, said metering apparatus further including a bleed valve engaged with said air bleed in said rich position to restrict air flow through said air bleed and thereby permit increased fuel flow through said idle fuel passage and displaced from said air bleed in said lean position to permit increased air flow through said air bleed and thereby restrict fuel flow through said idle fuel passage, wherein said valves are magnetically responsive and at least said metering valve is permanently magnetic, and wherein said carburetor further comprises an electromagnet pole member disposed between said valves, an electromagnet coil surrounding said pole member for causing said pole member to repel said metering valve and attract said bleed valve to said lean position when said coil is energized and for causing said pole member to attract said metering valve to said rich position when said coil is deenergized, and means for biasing said bleed valve to said rich position when said coil is deenergized.

6. A carburetor comprising main and idle fuel passages, a metering orifice in said main fuel passage, an air bleed opening into said idle fuel passage, and a metering apparatus reciprocable between a rich position and a lean position, said metering apparatus including a metering valve engaged with said metering orifice in said lean position to restrict fuel flow through said main fuel passage and displaced from said metering orifice in said rich position to permit increased fuel flow through said main fuel passage, said metering apparatus further including a bleed valve engaged with said air bleed in said rich position to restrict air flow through said air bleed and thereby permit increased fuel flow through said idle fuel passage and displaced from said air bleed in said lean position to permit increased air flow through said air bleed and thereby restrict fuel flow through said idle fuel passage, wherein said valves are magnetically responsive and at least one of said valves is permanently magnetic, and wherein said carburetor further comprises an electromagnet pole member associated with said valves, an electromagnet coil surrounding said pole member and energized according to a duty cycle which causes said pole member to repel said one valve and attract the other valve to said lean position during a portion of the duty cycle and causes said pole member to attract said one valve to said rich position during the remainder of the duty cycle, and means for biasing said other valve to said rich position during the remainder of the duty cycle.

7. A carburetor comprising main and idle fuel passages, a metering orifice in said main fuel passage, an air bleed opening into said idle fuel passage, and a metering apparatus reciprocable between a rich position and a lean position, said metering apparatus including a metering valve engaged with said metering orifice in said lean position to restrict fuel flow through said main fuel passage and displaced from said metering orifice in said rich position to permit increased fuel flow through said main fuel passage, said metering apparatus further including a bleed valve engaged with said air bleed in said rich position to restrict air flow through said air bleed and thereby permit increased fuel flow through said idle fuel passage and displaced from said air bleed in said lean position to permit increased air flow through said air bleed and thereby restrict fuel flow through said idle fuel passage, wherein said valves are magnetically responsive and at least said metering valve is permanently magnetic, and wherein said carburetor further comprises an electromagnet pole member disposed between said valves, an electromagnet coil surrounding said pole member and energized according to a duty cycle which causes said pole member to repel said metering valve and attract said bleed valve to said lean position during a portion of the duty cycle and causes said pole member to attract said metering valve to said rich position during the remainder of the duty cycle, and means for biasing said bleed valve to said rich position during the remainder of said duty cycle.

8. A carburetor comprising main and idle fuel passages, a metering orifice in said main fuel passage, an air bleed opening into said idle fuel passage, and a metering apparatus reciprocable between a rich position and a lean position, said metering apparatus including a metering valve engaged with said metering orifice in said lean position to restrict fuel flow through said main fuel passage and displaced from said metering orifice in said rich position to permit increased fuel flow through said main fuel passage, said metering apparatus further including a bleed valve engaged with said air bleed in said rich position to restrict air flow through said air bleed and thereby permit increased fuel flow through said idle fuel passage and displaced from said air bleed in said lean position to permit increased air flow through said air bleed and thereby restrict fuel flow through said idle fuel passage, wherein said valves are magnetically responsive and at least one of said valves is permanently magnetic, and wherein said carburetor further comprises an electromagnet pole member associated with said valves, an electromagnet coil surrounding said pole member for causing said pole member to repel said one valve and attract the other valve to said rich position when said coil is energized and for causing said pole member to attract said one valve to said lean position when said coil is deenergized, and means for biasing said other valve to said lean position when said coil is deenergized.

9. A carburetor comprising main and idle fuel passages, a metering orifice in said main fuel passage, an air bleed opening into said idle fuel passage, and a metering apparatus reciprocable between a rich position and a lean position, said metering apparatus including a metering valve engaged with said metering orifice in said lean position to restrict fuel flow through said main fuel passage and displaced from said metering orifice in said rich position to permit increased fuel flow through said main fuel passage, said metering apparatus further including a bleed valve engaged with said air bleed in said rich position to restrict air flow through said air bleed and thereby permit increased fuel flow through said idle fuel passage and displaced from said air bleed in said lean position to permit increased air flow through said air bleed and thereby restrict fuel flow through said idle fuel passage, wherein said valves are magnetically responsive and at least said bleed valve is permanently magnetic, and wherein said carburetor further comprises an electromagnet pole member associated with said valves, an electromagnet coil surrounding said pole member for causing said pole member to repel said bleed valve and attract said metering valve to one of said rich and lean positions when said coil is energized and for causing said pole member to attract said bleed valve to the other of said rich and lean positions when said coil is deenergized, and means for biasing said metering valve to said other position when said coil is deenergized.

10. A carburetor comprising main and idle fuel passages, a metering orifice in said main fuel passage, an air bleed opening into said idle fuel passage, and a metering apparatus reciprocable between a rich position and a lean position, said metering apparatus including a metering valve engaged with said metering orifice in said lean position to restrict fuel flow through said main fuel passage and displaced from said metering orifice in said rich position to permit increased fuel flow through said main fuel passage, said metering apparatus further including a bleed valve engaged with said air bleed in said rich position to restrict air flow through said air bleed and thereby permit increased fuel flow through said idle fuel passage and displaced from said air bleed in said lean position to permit increased air flow through said said air bleed and thereby restrict fuel flow through said idle fuel passage, wherein said valves are magnetically responsive and at least said bleed valve is permanently magnetic, and wherein said carburetor further comprises an electromagnet pole member disposed between said valves, an electromagnet coil surrounding said pole member for causing said pole member to repel said bleed valve and attract said metering valve to said rich position when said coil is energized and for causing said pole member to attract said metering valve to said lean position when said coil is deenergized, and means for biasing said metering valve to said lean position when said coil is deenergized.

11. A carburetor comprising main and idle fuel passages, a metering orifice in said main fuel passage, an air bleed opening into said idle fuel passage, and a metering apparatus reciprocable between a rich position and a lean position, said metering apparatus including a metering valve engaged with said metering orifice in said lean position to restrict fuel flow through said main fuel passage and displaced from said metering orifice in said rich position to permit increased fuel flow through said main fuel passage, said metering apparatus further including a bleed valve engaged with said air bleed in said rich position to restrict air flow through said air bleed and thereby permit increased fuel flow through said idle fuel passage and displaced from said air bleed in said lean position to permit increased air flow through said air bleed and thereby restrict fuel flow through said idle fuel passage, wherein said valves are magnetically responsive and at least one of said valves is permanently magnetic, and wherein said carburetor further comprises an electromagnet pole member associated with said valves, an electromagnet coil surrounding said pole member and energized according to a duty cycle which causes said pole member to repel said one valve and attract the other valve to said rich position during a portion of the duty cycle and causes said pole member to attract said one valve to said lean position during the remainder of the duty cycle, and means for biasing said other valve to said lean position during the remainder of the duty cycle.

12. A carburetor comprising main and idle fuel passages, a metering orifice in said main fuel passage, an air bleed opening into said idle fuel passage, and a metering apparatus reciprocable between a rich position and a lean position, said metering apparatus including a metering valve engaged with said metering orifice in said lean position to restrict fuel flow through said main fuel passage and displaced from said metering orifice in said rich position to permit increased fuel flow through said main fuel passage, said metering apparatus further including a bleed valve engaged with said air bleed in said rich position to restrict air flow through said air bleed and thereby permit increased fuel flow through said idle fuel passage and displaced from said air bleed in said lean position to permit increased air flow through said air bleed and thereby restrict fuel flow through said idle fuel passage, wherein said valves are magnetically responsive and at least said bleed valve is permanently magnetic, and wherein said carburetor further comprises an electromagnet pole member disposed between said valves, an electromagnet coil surrounding said pole member and energized according to a duty cycle which causes said pole member to repel said bleed valve and attract said metering valve to said rich position during a portion of the duty cycle and causes said pole member to attract said bleed valve to said lean position during the remainder of the duty cycle, and means for biasing said metering valve to said lean position during the remainder of the duty cycle.

* * * * *